US007804455B2

(12) United States Patent
Lee et al.

(10) Patent No.: US 7,804,455 B2
(45) Date of Patent: Sep. 28, 2010

(54) ANTENNA APPARATUS FOR LINEARLY POLARIZED DIVERSITY ANTENNA IN RFID READER AND METHOD OF CONTROLLING THE ANTENNA APPARATUS

(75) Inventors: Jong Moon Lee, Cheongju (KR); Nae-Soo Kim, Daejeon (KR); Cheol Sig Pyo, Daejeon (KR); Ik Guen Choi, Daejeon (KR)

(73) Assignees: Electronics and Telecommunications Reseach Institute, Daejeon (KR); Chungbuk National University Industry-Academic Cooperation Foundation, Cheongju (KR)

( * ) Notice: Subject to any disclaimer, the term of this patent is extended or adjusted under 35 U.S.C. 154(b) by 381 days.

(21) Appl. No.: 11/782,195

(22) Filed: Jul. 24, 2007

(65) Prior Publication Data

US 2008/0129641 A1 Jun. 5, 2008

(30) Foreign Application Priority Data

Dec. 5, 2006 (KR) ..... 10-2006-0122546

(51) Int. Cl.
*H01Q 21/00* (2006.01)

(52) U.S. Cl. ..... 343/725; 343/700 MS; 343/876; 340/572.7

(58) Field of Classification Search ..... 343/700 MS, 343/725, 853, 876; 340/572.1, 572.7
See application file for complete search history.

(56) References Cited

U.S. PATENT DOCUMENTS

| | | | | |
|---|---|---|---|---|
| 3,659,227 | A * | 4/1972 | Whistler | 333/103 |
| 3,887,925 | A * | 6/1975 | Ranghelli et al. | 343/795 |
| 5,966,102 | A * | 10/1999 | Runyon | 343/820 |
| 5,977,929 | A * | 11/1999 | Ryken | 343/797 |
| 6,933,909 | B2 * | 8/2005 | Theobold | 343/893 |
| 2004/0185793 | A1 | 9/2004 | Borlez et al. | |
| 2005/0093677 | A1 * | 5/2005 | Forster et al. | 340/10.1 |
| 2005/0128155 | A1 | 6/2005 | Fukuda | |
| 2007/0040687 | A1 * | 2/2007 | Reynolds | 340/572.7 |
| 2007/0194929 | A1 * | 8/2007 | Wagner et al. | 340/572.7 |

FOREIGN PATENT DOCUMENTS

| | | |
|---|---|---|
| JP | 2005-094474 | 4/2005 |
| KR | 1999-0039250 | 6/1999 |

* cited by examiner

*Primary Examiner*—Tho G Phan
(74) *Attorney, Agent, or Firm*—Ladas & Parry LLP

(57) ABSTRACT

Provided are an antenna apparatus for linearly polarized diversity antennas in a radio frequency identification (RFID) reader, and a method of controlling the antenna apparatus. The antenna apparatus includes: a plurality of linearly polarized diversity antennas disposed to have different directions to one another; a switching unit connecting the linearly polarized diversity antennas to the RFID reader; and a controller controlling the switching unit to selectively activate the linearly polarized diversity antennas.

7 Claims, 5 Drawing Sheets

ANTENNA APPARATUS FOR LINEARLY POLARIZED DIVERSITY ANTENNA IN RFID READER AND METHOD OF CONTROLLING THE ANTENNA APPARATUS

CROSS-REFERENCE TO RELATED PATENT APPLICATION

This application claims the benefit of Korean Patent Application No. 10-2006-0122546, filed on Dec. 5, 2006, in the Korean Intellectual Property Office, the disclosure of which is incorporated herein in its entirety by reference.

BACKGROUND OF THE INVENTION

1. Field of the Invention

The present invention relates to an antenna apparatus for a linearly polarized diversity antenna in an radio frequency identification (RFID) reader, and a method of controlling the antenna apparatus, and more particularly, to an antenna apparatus for a linearly polarized diversity antenna in an RFID reader, wherein the antenna apparatus communicates with the linearly polarized diversity antenna having the most matching polarization direction with a tag antenna in order to reduce a loss of an electric wave caused by a polarization mismatch, and a method of controlling the antenna apparatus.

2. Description of the Related Art

Conventionally, radio frequency identification (RFID) readers must accurately read data signals emitted from antennas of small RFID tags, which are attached to objects, using an ultrahigh frequency (UHF) band so as to apply to all types of fields including automatic distribution management in harbors, hospitals, and pharmaceutical companies, stock clearance and burglarproofing in stores, automatic arrangement of inventory of books in libraries, automatic searches for bags in airports, automatic control of road environments, traffic control, etc. However, an antenna of a small RFID tag is microsize and thus, necessarily has a low gain. Also, polarization of the antenna is randomly changed according to an arrangement and a state of an attached object. Thus, a portable reader having a limited size requires a linearly polarized diversity antenna having a small size and a high gain to reduce a loss of an electric wave caused by a polarization mismatch, and transmit and receive data with a tag for a far distance.

However, a conventional tag antenna as described above is conventionally a linearly polarized antenna. Thus, a microstrip antenna having a circularly polarized characteristic is widely used as a fixed/portable reader antenna. The microstrip antenna has a constant polarization mismatch loss regardless of the arrangement direction of an attached object. Thus, the micro-strip antenna transmits and receives a constant power to recognize all kinds of tags. As a result, a transceiver circuit of the micro-strip antenna has a relatively simple structure. However, a polarization mismatch loss of 6 dB occurs during two-way communications between a tag and a fixed/portable reader. Due to this, a communication distance between the tag and the reader is shortened.

SUMMARY OF THE INVENTION

The present invention provides an antenna apparatus for a plurality of linearly polarized diversity antennas in a radio frequency identification (RFID) reader in order to reduce a polarization mismatch loss and increase a communication distance, and a method of controlling the antenna apparatus.

According to an aspect of the present invention, there is provided an antenna apparatus for linearly polarized diversity antennas in an RFID reader, including: a plurality of linearly polarized diversity antennas disposed to have different directions to one another; a switching unit connecting the linearly polarized diversity antennas to the RFID reader; and a controller controlling switching unit to selectively activate the linearly polarized diversity antennas.

According to another aspect of the present invention, there is provided a method of controlling an antenna apparatus for linearly polarized diversity antennas in an RFID reader, including: controlling a plurality of linearly polarized diversity antennas in order for the linearly polarized diversity antennas to have different directions to one another; and switching on and/or off a current supplied to the linearly polarized diversity antennas.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
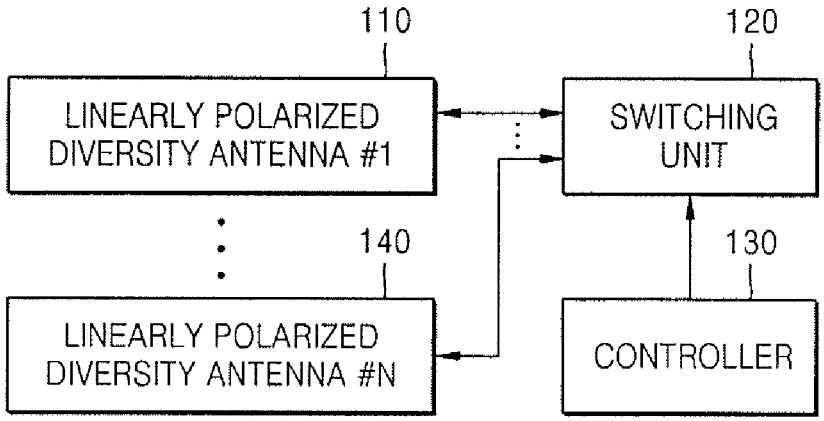
FIG. 1 is a block diagram of an antenna apparatus for linearly polarized diversity antennas in a radio frequency identification (RFID) reader according to an embodiment of the present invention.
Figure 2A:
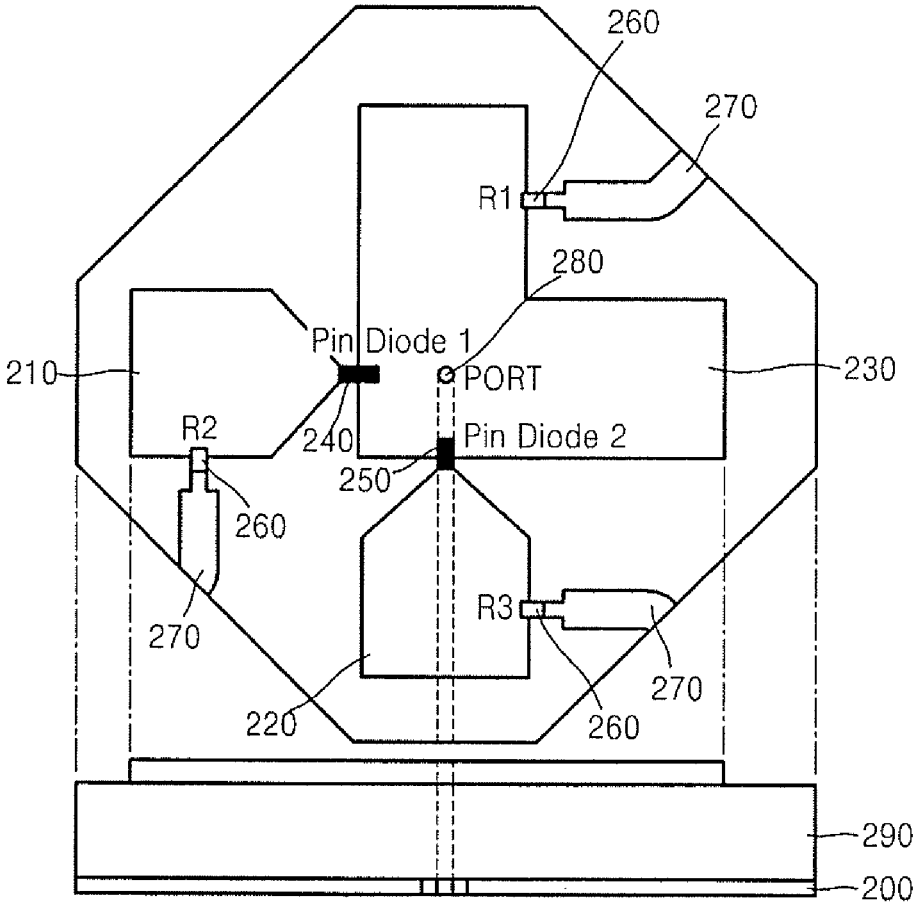
FIG. 2A is a cross-sectional view of horizontal and/or vertical antennas of the antenna apparatus according to an embodiment of the present invention.
Figure 2B:
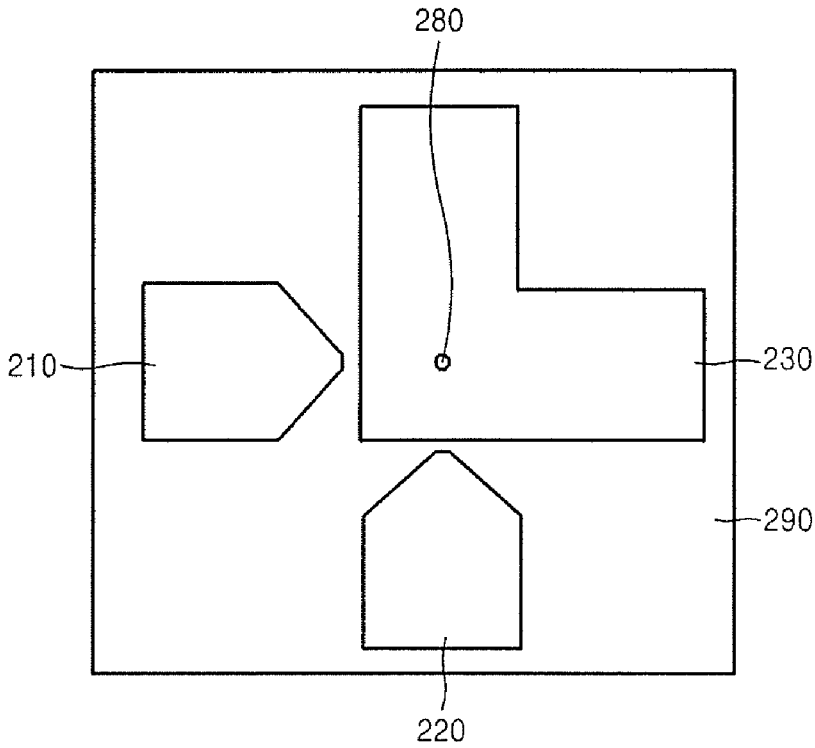
FIG. 2B is a pattern view of the horizontal and/or vertical antennas of the antenna apparatus of FIG. 1, according to an embodiment of the present invention.
Figure 2C:
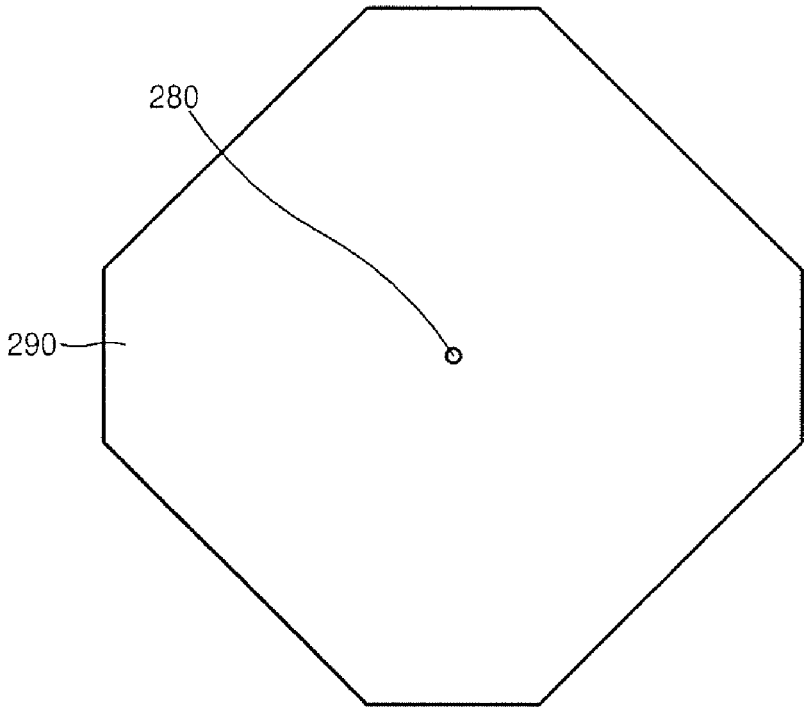
FIG. 2C is a ground pattern view of the horizontal and/or vertical antennas of the antenna apparatus of FIG. 1, according to an embodiment of the present invention.
Figure 3A:
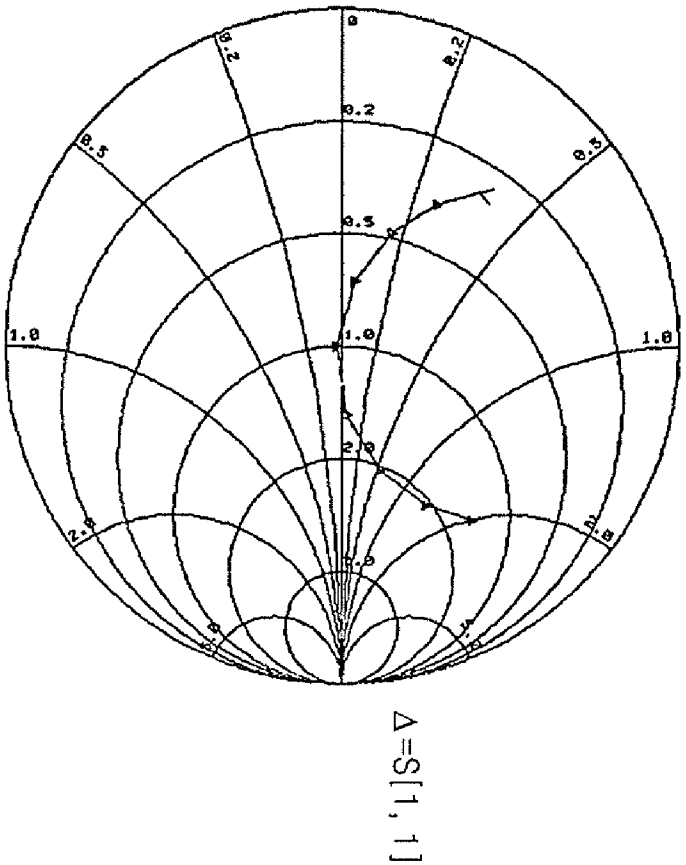
FIG. 3A is a view illustrating input impedances of the horizontal and/or vertical antennas when a diode attached to the horizontal antenna is switched on and a diode attached to the vertical antenna is switched off, according to an embodiment of the present invention.
Figure 3B:
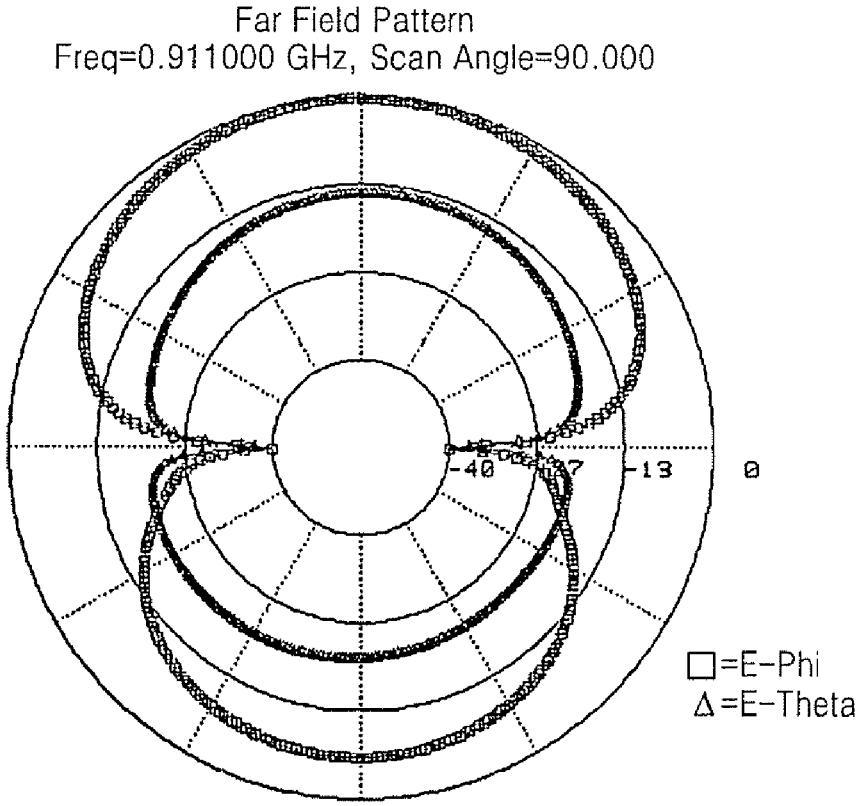
FIG. 3B is a view illustrating radiation patterns of the antenna apparatus on a horizontal surface, according to an embodiment of the present invention.
Figure 4A:
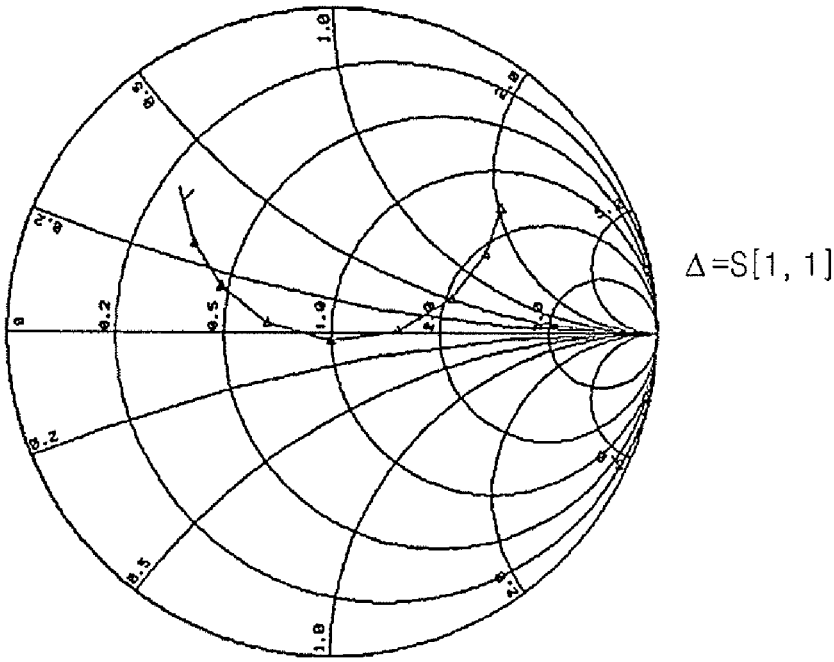
FIG. 4A is a view illustrating input impedances of the horizontal and/or vertical antennas when the diode attached to the vertical antenna is switched on and the diode attached to the horizontal antenna is switched off, according to an embodiment of the present invention.
Figure 4B:
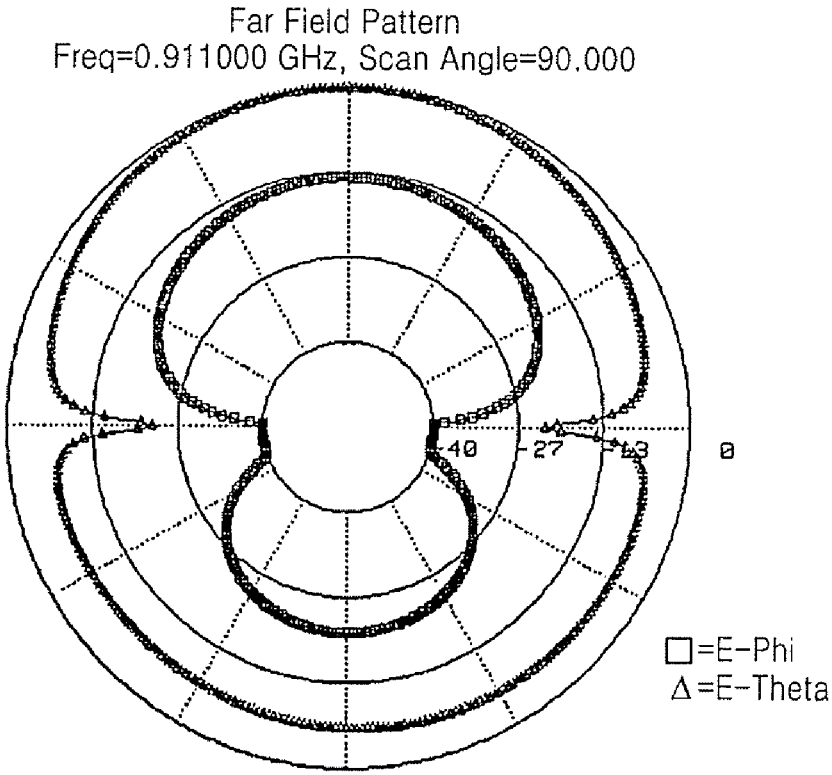
FIG. 4B is a view illustrating radiation patterns of the antenna apparatus on a vertical surface according to an embodiment of the present invention.
Figure 5:
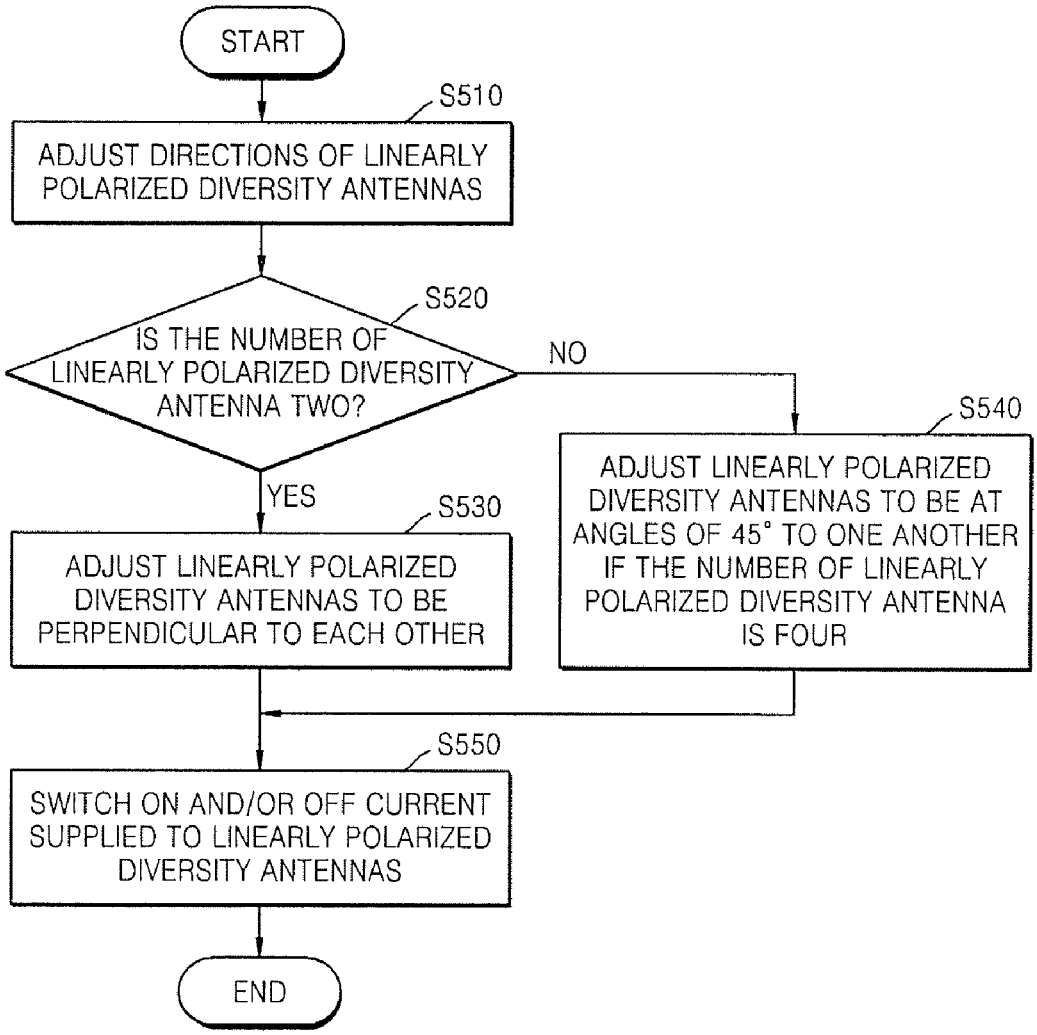
FIG. 5 is a flowchart of a method of controlling an antenna apparatus for linearly polarized diversity antennas in an RFID reader according to an embodiment of the present invention.

An antenna apparatus for a linearly polarized diversity antenna in a radio frequency identification (RFID) reader, and a method of controlling the antenna apparatus according to the present invention will now be described in detail with reference to the attached drawings. FIG. 1 is a block diagram of the antenna apparatus for a linearly polarized diversity antenna in the RFID reader according to an embodiment of the present invention. FIG. 2A is a cross-sectional view of horizontal and/or vertical antennas of the antenna apparatus, according to an embodiment of the present invention. FIG. 2B is a pattern view of the horizontal and/or vertical antennas of the antenna apparatus of FIG. 1, according to an embodiment of the present invention, and FIG. 2C is a ground pattern view of the horizontal and/or vertical antennas of the antenna apparatus of FIG. 1, according to an embodiment of the present invention. FIG. 3A is a view illustrating input impedances of the horizontal and/or vertical antennas when a diode attached to the horizontal antenna is switched on and a diode attached to the vertical antenna is switched off, according to an embodiment of the present invention, and FIG. 3B is a view illustrating radiation patterns of the antenna apparatus on a horizontal surface, according to an embodiment of the present invention. FIG. 4A is a view illustrating input impedances of the horizontal and/or vertical antennas when the diode attached to the vertical antenna is switched on and the diode attached to the horizontal antenna is switched off, according to an embodiment of the present invention, and FIG. 4B is a view illustrating radiation patterns of the antenna apparatus on a vertical surface, according to an embodiment of the present invention. FIG. 5 is a flowchart of a method of controlling an antenna apparatus for linearly polarized diversity antennas in an RFID reader according to an embodiment of the present invention.

The antenna apparatus for linearly polarized diversity antennas in an RFID reader, and the method of controlling the antenna apparatus according to an embodiment of the present invention will be described with reference to FIGS. 1 and 5. For convenience and easy understanding, the antenna apparatus and the method will be described simultaneously. In operation S510, first through $n^{th}$ linearly polarized diversity antennas 110 through N are disposed so that at least one or more of the first through $n^{th}$ linearly polarized diversity antennas 110 through N have constant and different directions to one another. In the present embodiment, the first through $n^{th}$ linearly polarized diversity antennas 110 through N may have micro-strip shapes. In operation S520, a determination is made as to whether the number of first through $n^{th}$ linearly polarized diversity antennas 110 through N is two. If it is determined in operation S520 that the number of first through $n^{th}$ linearly polarized diversity antennas 110 through N is two, the first through $n^{th}$ linearly polarized diversity antennas 110 through N are disposed to be perpendicular to each other in operation S530. If it is determined in operation S520 that the number of first through $n^{th}$ linearly polarized diversity antennas 110 through N is four, the first through $n^{th}$ linearly polarized diversity antennas 110 through N are disposed to be at angles of 45° to one another in operation S540. A switching unit 120 may connect the first through $n^{th}$ linearly polarized diversity antennas 110 through N to an RFID reader using a pin diode. A controller 130 controls the switching unit 120 to selectively activate the first through $n^{th}$ linearly polarized diversity antennas 110 through N. In other words, the controller 130 switches on and/or off the switching unit 120 in order to control a current supplied to the first through $n^{th}$ linearly polarized diversity antennas 110 through N and thus, selectively activate the first through $n^{th}$ linearly polarized diversity antennas 110 through N.

The structure of the antenna apparatus of FIG. 1 will now be described in more detail with reference to FIGS. 2A through 4B. However, the case where the number of the first through $n^{th}$ linearly polarized diversity antennas 110 through N is two will be described as an example. As shown in FIG. 2A, the horizontal and/or vertical antennas are micro-strip antennas 210 and 220, which cross each other and are fed by a probe feeder 280 to transmit and/or receive a signal. Each of the micro-strip antennas 210 and 220 is divided into two parts, and a diode 240 is inserted between the two parts of the micro-strip antenna 210 and a diode 250 is inserted between the two parts of the micro-strip antenna 220.

Power is supplied to a pattern 230 through power supply patterns 270 and then through resistors 260. Then, the power is transmitted to the micro-strip antennas 210 and 220 respectively through the diodes 240 and 250 connected to the pattern 230.

If the diode 240 that is inserted into the micro-strip antenna 210 is switched on, a current flows into the micro-strip antenna 210 through the diode 240. Thus, a resonance frequency in a horizontal direction mode is constant. As a result, the micro-strip antenna 210 operates as a horizontally polarized antenna at the resonance frequency. If the diode 250 that is inserted into the micro-strip antenna 220 is switched on, a current flows through the diode 250 into the micro-strip antenna 220. Thus, a resonance frequency in a vertical direction mode is constant. As a result, the micro-strip antenna 220 operates as a vertically polarized antenna at the resonance frequency. If the diode 240 that is inserted into the micro-strip antenna 210 is switched off, the current does not flow through the diode 240 into the micro-strip antenna 210, however, the current flows only to the diode 240. As a result, the length of the micro-strip antenna 210 is reduced. Thus, an input impedance of the micro-strip antenna 210 in a circular resonance frequency observed from the probe feeder is high. As such, the micro-strip antenna 210 operates as an open circuit.

If the diode 250 that is inserted into the micro-strip antenna 220 is switched off, the current does not flow through the diode 250 into the micro-strip antenna 220. Thus, the length of the micro-strip antenna 220 is reduced. As a result, an input impedance of the micro-strip antenna 220 in a circular resonance frequency observed from the probe feeder is high. As such, the micro-strip antenna 220 operates as an open circuit. Accordingly, if the diode 240 that is inserted into the micro-strip antenna 210 is switched on and the diode 250 that is inserted into the micro-strip antenna 220 is switched off, the micro-strip antennas 210 and 220 operate as horizontally polarized antennas at a resonance frequency and a characteristic of impedance matching at the probe feeder is maintained. If the diode 250 that is inserted into the micro-strip antenna 220 is switched on and the diode 240 that is inserted into the micro-strip antenna 210 is switched off, the micro-strip antennas 210 and 220 operate as vertically polarized antennas at the resonance frequency and a characteristic of impedance matching at the probe feeder is maintained.

FIG. 2B is a pattern view of the micro-strip antennas 210 and 220, and FIG. 2C is a ground pattern view of the micro-strip antennas 210 and 220. The probe feeder 280 may be a coaxial connector having a diameter of 1.3 mm. FIGS. 2A through 2C shows a position and a connection structure of the probe feeder 280 with ground 200. In FIGS. 2A through 2C, a ground surface 200, and a substrate 290 are shown. FIG. 3A illustrates input impedances of the micro-strip antennas 210 and 220 when the diode 240 that is inserted into the horizontal antenna 210 is switched on while the diode 250 that is inserted into the micro-strip antenna 220 is switched off. FIG. 3B illustrates radiation patterns in a horizontal direction. As shown in FIG. 3B, the input impedances, radiation patterns, and cross poles of the micro-strip antennas 210 and 220 are obtained through a simulation and the analysis of the results of the simulation can be understood by one of ordinary skill in the art, and thus, its detailed description will be omitted.

FIG. 4A illustrates input impedances of the micro-strip antennas 210 and 220 when the diode 250 that is inserted into the vertical antenna 220 is switched on while the diode 240 that is inserted into the vertical antenna 210 is switched off-.FIG. 4B illustrates radiation patterns in a vertical direction.

As shown in FIG. 4B, the input impedances, radiation patterns, and cross poles of the micro-strip antennas 210 and 220 are obtained through a simulation and the analysis of the results of the simulation can be understood by one of ordinary skill in the art, and thus, its detailed description will be omitted.

During the simulations, the right and left sides (or above and below) of the mirco-strip antennas at which the diodes are positioned are replaced with 1×1-mm square patches. Instead of switching off the diodes 240 and 250, the simulations were performed with a gap of 1 mm between the above and below sides (or right and left) of the mirco-strip antennas at which the diodes are_positioned_Table 1 illustrates the results of the simulations performed on the micro-strip antennas 210 and 220.

TABLE 1

| Item | Standards | Notes |
|---|---|---|
| Operating Frequency Band | 908.5 MHz~914 MHz | |
| Polarization | Horizontal/Vertical Linear Polarization | |
| Return Loss | −10 dB or less | |
| Gain | 3.48 dBi | |
| Antenna Size | less than 8 cm × 8 cm | |
| Isolation Degree of Cross Poles | 13 dB or less | |

An antenna apparatus for linearly polarized diversity antennas in an RFID reader according to the present invention is not limited to the above-described embodiment and may be modified into various forms as long as within the scope of the present invention. Also, the design theory of the present invention may be applied to various kinds of antennas such as domestic RFID reader antennas, foreign RFID antennas, mobile communication diversity antennas, etc.

As described above, in the antenna apparatus for linearly polarized diversity antennas in an RFID reader, and the method of controlling the antenna apparatus according to the present invention, the narrowband characteristics of patch antennas can be used. Also, pin diodes can be installed in appropriate positions so that related direction modes are constant. Thus, a single fed antenna having horizontally and/or vertically polarized diversity characteristics using two pin diodes can be designed. In addition, a single fed antenna having 4-directions linearly polarized diversity characteristics using four pin diodes can be designed and realized.

In terms of a circularly polarized antenna, an antenna having horizontal and/or vertical polarized diversity characteristics has a polarization mismatch loss of 6 dB as compared to a circularly polarized antenna of the present invention in which the polarization mismatch loss of the antenna can be improved by 6 dB. An antenna having 4-directions linearly polarized diversity characteristics has a polarization mismatch loss of 1.38 dB as compared to the circularly polarized antenna of the present invention in which the polarization mismatch loss of the antenna can be improved from 4.62 dB to 6 dB. Thus, the design of the present invention can be applied to domestic and foreign RFID readers and mobile communication diversity antennas in order to be greatly competitive in international and domestic markets.

The present invention can also be embodied as computer readable codes on a computer readable recording medium. The computer readable recording medium is any data storage device that can store data, which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion.

While the present invention has been particularly shown and described with reference to exemplary embodiments thereof, it will be understood by one of ordinary skill in the art that various changes in form and details may be made therein without departing from the spirit and scope of the present invention as defined by the following claims.

What is claimed is:

1. An antenna apparatus for linearly polarized diversity antennas in an RFID (radio frequency identification) reader, the antenna apparatus comprising:

four linearly polarized diversity antennas disposed to have different directions to one another, wherein the four linearly polarized diversity antennas are disposed at angles of 45° relative to one another and has a polarization mismatch loss of about 1.38 dB;

a switching unit connecting the linearly polarized diversity antennas to the RFID reader; and a controller controlling the switching unit to selectively activate the linearly polarized diversity antennas.

2. The antenna apparatus of claim 1, wherein if the number of linearly polarized diversity antennas is two, the linearly polarized diversity antennas are disposed to be perpendicular to each other.

3. The antenna apparatus of claim 1, wherein the linearly polarized diversity antennas have micro-strip shapes.

4. The antenna apparatus of claim 1, wherein the controller controls the switching unit in order to switch on and/or off a current that is supplied to the linearly polarized diversity antennas.

5. The antenna apparatus of claim 4, wherein the switching unit is a pin diode.

6. A method of controlling an antenna apparatus for linearly polarized diversity antennas in an RFID reader, the method comprising:

controlling four linearly polarized diversity antennas in order for the linearly polarized diversity antennas to have different directions to one another, wherein the four linearly polarized diversity antennas are disposed at angles of 45° relative to one another and has a polarization mismatch loss of about 1.38 dB; and switching on and/or off a current supplied to the four linearly polarized diversity antennas.

7. The method of claim 6, wherein a pin diode is switched on and/or off to control the current supplied to the four linearly polarized diversity antennas.

* * * * *